US010218090B2

(12) United States Patent
Fietz et al.

(10) Patent No.: US 10,218,090 B2
(45) Date of Patent: Feb. 26, 2019

(54) CONNECTOR FOR SUPERCONDUCTING CONDUCTORS, AND USE OF THE CONNECTOR

(71) Applicant: Karlsruher Institut für Technologie, Karlsruhe (DE)

(72) Inventors: Walter Fietz, Karlsruhe (DE); Michael J. Wolf, Karlsruhe (DE); Reinhard Heller, Karlsruhe (DE); Klaus-Peter Weiss, Karlsruhe (DE)

(73) Assignee: Karlsruher Institut für Technologie, Karlsruhe (DE)

( * ) Notice: Subject to any disclaimer, the term of this patent is extended or adjusted under 35 U.S.C. 154(b) by 0 days.

(21) Appl. No.: 15/752,221

(22) PCT Filed: Aug. 10, 2016

(86) PCT No.: PCT/EP2016/001370
§ 371 (c)(1),
(2) Date: Feb. 12, 2018

(87) PCT Pub. No.: WO2017/025191
PCT Pub. Date: Feb. 16, 2017

(65) Prior Publication Data

US 2018/0226730 A1 Aug. 9, 2018

(30) Foreign Application Priority Data

Aug. 12, 2015 (DE) ..... 10 2015 010 634

(51) Int. Cl.
*H01R 4/68* (2006.01)
*H01B 12/06* (2006.01)
(Continued)

(52) U.S. Cl.
CPC ..... *H01R 4/68* (2013.01); *H01B 12/06* (2013.01); *H01R 4/02* (2013.01); *H01R 4/187* (2013.01); *H01R 43/28* (2013.01)

(58) Field of Classification Search
CPC . H01R 4/68; H01R 4/02; H01R 4/187; H01R 43/28; H01B 12/16
(Continued)

(56) References Cited

U.S. PATENT DOCUMENTS 3,864,508 A * 2/1975 Beck ..... H01B 12/06 174/131 R
4,101,731 A * 7/1978 Marancik ..... H01L 39/14 174/125.1
(Continued)

FOREIGN PATENT DOCUMENTS

GB 2 498 961 A 8/2013
JP H03 43971 A 2/1991
(Continued)

OTHER PUBLICATIONS

International Search Report, dated Oct. 24, 2016, for related PCT Application No. PCT/EP2016/001370, 4 pages.

*Primary Examiner* — Michael F McAllister
(74) *Attorney, Agent, or Firm* — Klarquist Sparkman, LLP

(57) ABSTRACT

The disclosed connector can be used to connect superconductive conductors. The connector, which is suitable for electrically connecting at least one first superconductive conductor to at least one second superconductive conductor, includes an electrically conductive base element having a first end portion and a second end portion, and at least one superconductive additional element arranged in the base element extending from the first end portion to the second end portion of the base element.

19 Claims, 9 Drawing Sheets

(51) Int. Cl.
*H01R 4/02* (2006.01)
*H01R 43/28* (2006.01)
*H01R 4/18* (2006.01)

(58) Field of Classification Search
USPC ..... 174/125.1
See application file for complete search history.

(56) References Cited

U.S. PATENT DOCUMENTS

| | | | | |
|---|---|---|---|---|
| 4,377,905 | A * | 3/1983 | Agatsuma | H01F 6/06 148/98 |
| 8,586,868 | B2 * | 11/2013 | Liu | H02G 3/0481 174/113 C |
| 2005/0061537 | A1 * | 3/2005 | Yumura | H01R 4/68 174/125.1 |
| 2012/0309631 | A1 * | 12/2012 | Arndt | H01F 6/065 505/220 |

FOREIGN PATENT DOCUMENTS

| | | | |
|---|---|---|---|
| JP | 2005 310395 | A | 11/2005 |
| JP | 2010 010061 | A | 1/2010 |

* cited by examiner

CONNECTOR FOR SUPERCONDUCTING CONDUCTORS, AND USE OF THE CONNECTOR

CROSS REFERENCE TO RELATED APPLICATIONS

This is the U.S. National Stage of International Application No. PCT/EP2016/001370, filed Aug. 10, 2016, which in turn claims the benefit of German Patent Application No. 10 2015 010 634.1, filed Aug. 12, 2015. German Patent Application No. 10 2015 010 634.1 is incorporated herein in its entirety.

The invention relates to a connector for superconductive conductors and to a use of the connector.

Superconductors are materials whose electrical resistance completely disappears below a certain temperature, the transition temperature. Consequently, superconductors have no electrical DC losses if operated at sufficiently low temperatures. Consequently, a conductor for carrying electricity or a coil of such superconductive materials has no DC losses. Thus, current can be transmitted very effectively through such a conductor. In particular, high magnetic fields can be generated very efficiently using superconductive magnets. A distinction is made between low-temperature and high-temperature superconductors according to the value of the temperature of the phase transition from the superconductive to the normally conducting state. In low-temperature superconductors, it is typically below 30 K, in high-temperature superconductors in some cases very clearly higher, e.g. above the boiling point of nitrogen (T=−196° C.). Therefore, high-temperature superconductors (HTS) are also under discussion with regard to further applications, because—compared to low-temperature superconductors—the effort of cooling is significantly reduced. These include, among others, the energy transmission, rotating machines, such as generators, motors, etc., or magnets, e.g. for particle accelerators.

High-temperature superconductors of rare earth barium copper oxide materials (shortly REBCO), in view of the field and temperature ranges as well as the current density, are the most interesting HTS materials currently available on the market. These materials are produced in the form of thin strips or ribbons, in which the superconductor is deposited onto a substrate as a thin layer having a thickness of about 1 μm, so that a strip having a typical thickness of 100 μm is formed with a width in the millimeter range. For these fiat strips, it is not possible to use classic stranding techniques for the production of superconductive conductors or cables of high current-carrying capacity.

Instead, in recent approaches, stacks of superconductive strips or ribbons are produced in order to manufacture electrical conductors or cables for higher currents from the superconductive conductors.

In the transmission of high electrical power through superconductors, the conductors must be cooled accordingly. In order to achieve high current densities in the bundle or cable, they must be as compact as possible. At the same time, however, high mechanical stability is necessary as well, e.g. with regard to mechanical support with minimal heat input, thermal cycles or electromagnetic forces.

To use such superconductive conductors or cables in applications, however, not only the conductors themselves, but also electrical connectors with which the superconductive conductors can be assembled or connected, are crucial as well. In particular, it is important with such superconductive conductors that an electrical connector resistance and/or connection resistance resulting from the connection is as low as possible or negligible. Connector resistance as used in this specification particularly is understood to be the electrical resistance of the connector itself. The sum of the connector resistance and possibly occurring contact resistances between the conductors and the connector will be referred to as connection resistance below.

Conventionally, the individual superconductor strips of a superconductive conductor or cable are individually contacted with the superconductor strips of another superconductive conductor or cable. However, this is very time-consuming and expensive and therefore not suitable for industrial purposes.

Another known way to connect superconductive cables to each other is the so-called lap-joint connection. Here, the superconductive conductors are soldered e.g. in a copper block such that the ends of the conductors to be connected overlap. Due to the overlap, the current can flow directly from one conductor into another over the entire soldered-in length of the superconductive conductors. Depending on the degree of overlap, the electrical connector resistance can be kept low.

However, the conventional solutions have drawbacks. For example, it is very time-consuming to establish direct connections of the individual superconductor strips. In addition, such connections may be relatively unstable. In the lap-joint connections, the greatest possible overlap of the conductors to be connected is advantageous to reduce the connector resistance. However, this comes at the expense of compactness. In addition, the conventional connecting methods and connectors are very inflexible in use, particularly during laying of superconductive conductors or cables. A flexible connection and laying of superconductive conductors or cables plays an important role especially because the superconductor stacks, from which the conductors or cables are usually made, can be bent only to a very limited extent.

It is therefore an object of the present invention to provide a connector for superconductive conductors or cables, which is compact, easy to handle and flexible in use.

This object is solved by the subject matters of the independent claims. Advantageous embodiments are subject of the subclaims.

A first independent aspect for achieving the object relates to a connector for electrically connecting at least a first superconductive conductor with at least one second superconductive conductor, comprising:

- an electrically conductive base element having a first end portion, at which the at least first superconductive conductor is electrically contactable, and in particular solderable, and a second end portion, at which the at least second superconductive conductor is electrically contactable; and
- at least one superconductive additional element arranged in the base element at least in part(s) and extending from the first end portion to the second end portion of the base element.

The base element or the base body of the connector is primarily the mechanical connection or intermediate piece between the superconductive conductors or cables to be electrically connected. However, the base element is also electrically conductive, i.e. at least normally conductive. Preferably, the base element is formed at least partially or entirely from a conductive metal, such as copper, aluminum or silver. For example, the base element is a copper block. The base element has a first end portion or first end and a second end portion or second end. The first end portion or first end of the base element is adapted to be contacted, i.e.

to be electrically connected, with at least a first superconductive conductor or cable. For example, the first end portion can be contacted with one, two, three, four, etc. first superconductive conductors. Correspondingly, the second end portion or second end of the base element is also adapted to be contacted, i.e. to be electrically connected, with at least a second superconductive conductor or cable. For example, the second end portion can be contacted with one, two, three, four, etc. second superconductive conductors. In particular, each end portion of the connector or of the base element can have one or more intended contact points for contacting one or more superconductive conductors or cables.

First and second conductors as defined in this specification mean two conductors to be electrically connected. Contacting means electrically connecting, in particular thermally joining or soldering or also pressing in suitable materials, such as indium.

The at least one first and the at least one second conductor are not part of the connector according to the invention. Only in an assembled state of the connector is the at least one first conductor connected to the first end portion of the connector and/or is the at least one second conductor connected to the second end portion of the connector.

The at least one superconductive additional element preferably comprises a superconductor or a superconductive strip, and most preferably a high-temperature superconductor or a high-temperature superconductive strip, so that with appropriate cooling, i.e. at temperatures below the transition temperature of the superconductor, there is a superconductive electrical connection between the first end portion and the second end portion of the connector. In other words, the at least one superconductive additional element is arranged in such a way that, below the transition temperature of the superconductive additional element, it connects the first end portion and the second end portion to each other in a superconducting manner. The at least one superconductive additional element thus acts as a superconductive bypass, which is why the connector according to the invention is referred to as "SC-ByPass Connector" by the inventors.

In the assembled state, the at least one superconductive additional element causes a substantially superconductive electrical connection between the at least one first superconductive conductor and the at least one second superconductive conductor. "Substantially superconductive" mean or should be considered such that, where appropriate, contact resistances are possible at the contact points between the conductors and the connector.

The at least one superconductive additional element in particular is not part of a conductor to be connected, but is a separate part of the connector according to the invention, in other words, the at least one superconductive additional element is integrated in the connector independently of the conductors to be connected. The at least one superconductive additional element is arranged or integrated in the base element at least in part(s). Here, the term "at least in part(s)" includes the terms "partially", "in portions" or "completely", in particular, the at least one superconductive base element is arranged within the base element, in particular in a groove, a recess or in a cavity of the base element, at least in part(s).

The at least one superconductive additional element in the connector according to the invention has the advantageous effect that when two or more conductors are connected, the current does not have to flow through the base element over the entire distance, but via the at least one additional element, which at sufficiently low temperatures, i.e. temperatures below the transition temperature of the additional element, has no electrical resistance. Thus, the electrical resistance of the connector can be largely minimized or neglected. Moreover, no overlap of the conductors to be connected is necessary, so that the connector according to the invention can be very compact.

Unlike conventional types of connections, which usually are based on contacting the individual superconductor strips of the conductors to be connected individually, advantageous contacts between a whole conductor or cable can be realized by the inventive connector. Such contacts are easy to establish and are therefore also suitable for industrial use.

It is understood that the connector according to the invention is suitable not only for electrically connecting superconductive conductors or cables, but also for connecting any other, in particular normally conducting conductors or cables.

In a preferred embodiment, the base element has at least one recess or groove, in which the at least one superconductive additional element is arranged at least in part(s). Alternatively or additionally, the at least one superconductive additional element is connected to the base element in electrical contact therewith, or is electrically connected to the base element. For example, the superconductive additional element is inserted, pressfitted and/or soldered into the recess or groove. The groove may be arranged or formed on a surface or outside of the base element. A recess may be arranged or formed in inside the base element, in particular as a through opening from the first to the second end portion.

In a further preferred embodiment, the base element comprises several base element parts. In other words, the base element may be composed of several base element parts. In the mounted or assembled state of the connector, the entirety of the base element parts constitutes the base element. In particular, the base element parts may be formed such that in the assembled state of the connector, between two base element parts, a groove or recess is formed in the base element.

Alternatively or additionally, the base element comprises a joint or hinge. In this way, it is advantageously possible to bend the base element and the connector in a simple manner.

Alternatively or additionally, the base element is formed partially or completely of copper. For example, the base element comprises one or more copper blocks. En particular, the base element may be a copper block.

Alternatively or additionally, the at least one superconductive additional element comprises or is at least one superconductor strip, in particular a high-temperature superconductor strip. Preferably, the at least one superconductive additional element comprises a stack of superconductor strips or the at least one superconductive additional element is a stack of superconductor strips.

A superconductor strip is a strip comprising a substrate, on which a superconductor, especially a high-temperature superconductor such as REBGO, is applied as a thin layer, for example with a thickness of about 1 μm. The substrate may have a thickness of about 100 μm. A superconductor strip thus also has a thickness of about 100 μm, for example, and may have a width of several millimeters.

In a further preferred embodiment, the base element comprises several base element parts or base element portions, which in particular are movable into each other in order to compensate for changes in length, wherein a length of the at least one superconductive additional element is greater than the sum of the lengths of the base element parts. In other words, a length of the at least one superconductive additional element is greater than a length of the base element. For example, the at least one superconductive additional element may be arranged around the base element in an arcuate manner, in particular in a central portion of the connector. In other words, the at least one superconductive additional element may be formed or bent in a C-shape, in particular in a central portion of the connector. Preferably, the bent portion of the at least one superconductive additional element has a radius of >1 cm. Thus, it can be ensured that the at least one superconductive additional element or its superconductor strip(s) is/are bent substantially degradation-free and thus continue(s) to transmit the current in case of angular changes or changes in length of the base element.

Preferably, the connector or the base element or at least one of the base element parts comprises a displacement groove, in which one or more base element parts are movable or displaceable. With the help of the groove, the base element or the connector is variable or adjustable in length.

In a base element comprising several base element parts, the at least one superconductive additional element or the at least one superconductive strip stack can be arranged or attached e.g. on the inside of the base element parts in a simple manner. Moreover, the conductors or cables to be connected to the connector can be contacted, particularly pressfitted or soldered with the end portions of the connector in a simple manner. The gap between cable and connector can be reduced and thus optimized in a simple manner.

In a further preferred embodiment, the connector or the base element is adapted to electrically connect n first superconductive conductors to n second superconductive conductors, wherein the connector comprises n or an integral multiple of n superconductive additional elements, and wherein n is a natural integer greater than zero. In particular, n is 1, 2, 3, 4, 5, etc.

In a further preferred embodiment, the at least one conductive base element and in particular also the at least one superconductive additional element is formed to be rectilinear or angled or bent. Alternatively or additionally, the at least one conductive base element and in particular also the at least one superconductive additional element is formed such that, in an assembled state of the connector, a longitudinal axis of at least one first superconductive conductor and a longitudinal axis of the at least one second superconductive conductor enclose or form an angle between 0° and 180°. Here, an angle of 0° means a rectilinear connector, and an angle of 180° means a U-shaped connector, for example.

In the assembled state, the first end portion of the base element is contacted or connected with at least a first superconductive conductor and/or the second end portion of the base element is contacted or electrically connected with at least a second superconductive conductor.

The shape of the connector, i.e. of the base element and/or of the superconductive additional element, can be customized so that straight connections and angled connections can be realized. Thus, it is not necessary to bend the superconductive conductor or the superconductive cable strongly. In currently available superconductive conductors, such bending, in particular due to the stacked superconductor single strips or the superconductor body of the conductors formed thereby, usually results in a degradation of the superconductor. Such degradation can be avoided with the connector according to the invention. Compared to superconductor stacks, superconductor single strips can be bent relatively strongly in one bending direction, for example in a radii of a few centimeters. Thus, when a superconductive additional element comprising a single or only a few superconductor strips is used, also strongly angled or bent connectors can be realized.

With the connector according to the invention, an arbitrary path or way, e.g. in pipes, ducts or shafts, can the laid out or laid with substantially rectilinear superconductive conductors and with the help of respective connectors or elbows according to the invention. You could see some resemblance to the laying water pipes, if the aspect of cooling is neglected: The connectors play the role of the press or solder fittings, the superconductive conductors play the role of the pipes.

A further independent aspect for achieving the object relates to a use of the connector according to the invention for connecting at least one first superconductive conductor with at least one second superconductive conductor.

Preferably, the at least one first and the at least one second superconductive conductor each comprise a plurality of superconductor strips, which are each arranged into a strip stack and which each form a superconductor body of the respective superconductive conductor.

In particular, the at least one first superconductive conductor comprises a plurality of superconductor strips, which are arranged into a first strip stack and form a first superconductor body of the at least one first superconductive conductor. Correspondingly, the at least one second superconductive conductor comprises a plurality of superconductor strips, which are arranged into a second strip stack and form a second superconductor body of the at least one second superconductive conductor.

In particular, the superconductor body has a cross-shaped cross-section. In particular, the strip stack of superconductor body has superconductor strips with exactly two different widths.

In a preferred embodiment, the first end portion of the connector is electrically contacted with the superconductor body of the at least one first superconductive conductor. Alternatively or additionally, the second end portion of the connector is electrically contacted with the superconductor body of the at least one second superconductive conductor.

In a further preferred embodiment, the first end portion of the connector is electrically contacted with a cladding tube of the at least one first superconductive conductor. Alternatively or additionally, the second end portion of the connector is electrically contacted with a cladding tube of the at least one second superconductive conductor.

It is also possible to electrically contact the first end portion of the connector with both the cladding tube and the superconductor body of the at least one first superconductive conductor. Correspondingly, it is possible to electrically contact the second end portion of the connector with both the cladding tube and the superconductor body of the at least one second superconductive conductor.

In a further preferred embodiment, electrical contacting is achieved by pressfitting or thermal joining, in particular by connecting by means of heating or by soldering.

For the above-mentioned further independent aspect and in particular for corresponding preferred embodiments, the statements made above or below with regard to the embodiments of the first aspect apply as well. In particular, for an independent aspect of the present invention and for corresponding preferred embodiments, the statements made above or below with regard to the embodiments of the respective other aspects apply as well.

In particular, in the context of the present disclosure, a superconductive system comprising a first superconductive conductor, a second superconductive conductor and the connector according to the invention is provided as well. The connector is used in particular for electrically connecting the first and second superconductive conductors. In particular, the connector connects the first superconductive conductor with the second superconductive conductor electrically. In particular, the first and/or the second superconductive conductor or the strip stack or the superconductor body of the first and/or second superconductive conductor, as described above and/or below, has a cross-shaped cross-section. The cross-shaped cross-section is in particular realized in that the superconductor body is formed of a strip stack, which exclusively has strips with two different widths or exclusively consists of strips with two different widths.

In the following, individual embodiments for achieving the object will be described by way of example on the basis of figures. Here, the individual embodiments described partly have features that are not necessarily required to carry out the claimed subject matter, but which in certain applications provide desired properties. Thus, embodiments not including all the features of the embodiments described in the following should be considered to be disclosed by the technical teaching as well. Further, to avoid unnecessary repetition, certain features are only mentioned with respect to individual embodiments described below. It is pointed out that the individual embodiments should not be considered in an isolated way only, but also in combination. The skilled person will recognize from this combination that individual embodiments may also be modified by incorporating single or multiple features of other embodiments. It should be noted that a systematic combination of the individual embodiments with individual or several features described with respect to other embodiments may be desirable and useful and therefore should be taken into consideration and regarded as included in the specification.

BRIEF DESCRIPTION OF THE DRAWINGS

FIG. 1 shows a schematic sketch of a conventional lap-joint connection of two electrical conductors. In this lap-joint connection, the connector consists merely of an electrically conducting intermediate piece 15, which has recesses in which the conductors to be connected can be soldered.

As shown in FIG. 1, a first conductor 10 and a second conductor 20 are soldered into recesses of a copper block 15 such that the first conductor 10 and second conductor 20 overlap. In this way, current can flow over the completely soldered length of the conductors 10 and 20 directly from the first conductor 10 into the second conductor 20, or vice versa. The connector or the intermediate piece 15 has no additional superconductor.

Alternatively to the lap-joint connection, the superconductor of the first conductor 10 and the superconductor of the second conductor 20 are conventionally split up into individual components and then connected to each other individually.

Figure 1:
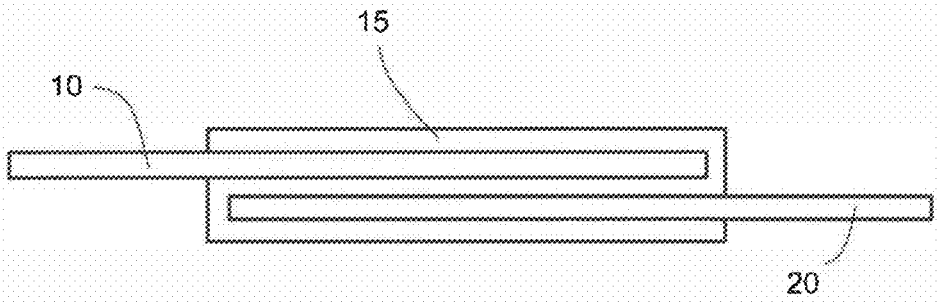
FIG. 1 shows a schematic diagram of a conventional lap-joint connection.
Figure 2:
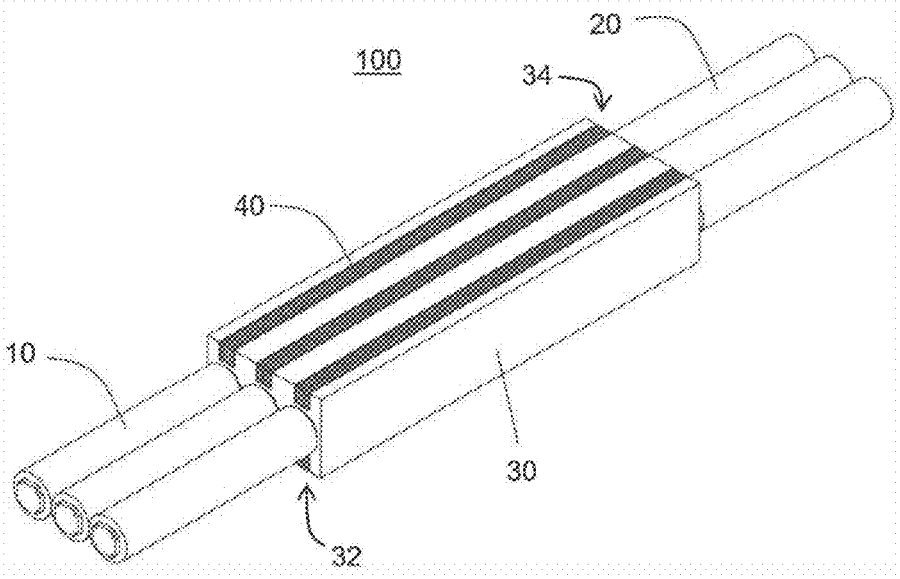
FIG. 2 shows a schematic drawing of a connector according to an embodiment of the present invention.

FIG. 2 shows a schematic drawing of a connector 100 according to an embodiment of the present invention. In this first embodiment, the connector 100 is formed in a rectilinear fashion and is shown in an assembled state.

The connector 100 comprises a base element 30 and at least one superconductive additional element 40. In the example of FIG. 2, the connector 100 comprises in particular six superconductive additional elements 40. Each of these superconductive additional elements 40 of the base element 30 is arranged in an associated recess or groove of the base element 30 and extends from a first end portion or end 32 to a second end portion or end 34 of the base element 30.

In the example of FIG. 2, in the assembled state of the connector 100, the first end portion 32 of the connector 100 is contacted or electrically connected with three first superconductive conductors or cables 10. Correspondingly, in the assembled state of the connector 100, the second end portion 34 is contacted or electrically connected with three second superconductive conductors 20. In particular, the superconductive conductors 10, 20 are respectively soldered to the respective ends 32, 34 of the connector 100.

In the example of FIG. 2, three superconductive additional elements 40 are arranged on a top side of the base element 30, while three further superconductive additional elements 40 are arranged on a bottom side of the base element 30 opposite to the top side. In particular, respectively two superconductive additional elements are opposite to each other, i.e. one superconductive additional element of the top side of the base element 30 is opposed to one superconductive additional element of the bottom side of the base element 30. In the assembled state of the connector 100, each of the first superconductive conductors 10 contacts at least one superconductive additional element 40, especially one associated with the intended contact point. In this way, it is ensured that the current, at least below the transition temperature of the superconductive additional elements 40, flows substantially through the superconductive additional elements 40 of the connector 100. The connector or connection resistance of the connector 100 can thus be minimized.

Figure 3:
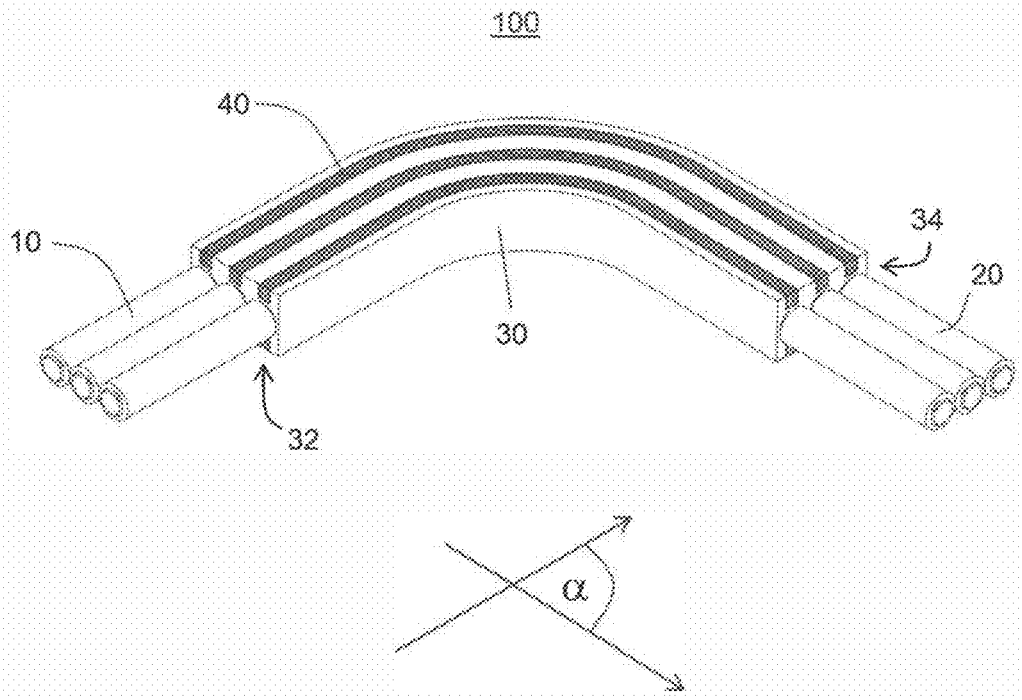
FIG. 3 shows a schematic drawing of a connector according to a further embodiment of the present invention.

FIG. 3 shows a schematic drawing of a connector 100 according to a further embodiment of the present invention. In this further embodiment, the connector 100 differs from the embodiment according to FIG. 2 only in that the connector 100 is formed to be angled or bent. In particular, the base dement 30 and also the superconductive additional elements 40 are formed to be angled or bent.

As also shown in FIG. 3, the at least one conductive base element 30 and also the at least one superconductive additional element 40 are shaped such that in the assembled state of the connector 100, a longitudinal axis of the at least one first superconductive conductor 10 and a longitudinal axis of at least one second superconductive conductor 20 enclose or form an angle α. In the rectilinear connector 100 according to FIG. 2, α=0°. In the connector according to FIG. 3, α is about 90°. In principle, the angle α can have any value greater than or equal to 0 and less than or equal to 180°. For α=180°, the connector is U-shaped. Specifically, a plurality of connectors 100 can be manufactured with different angles α, so that they can be used as required.

Figure 4A:
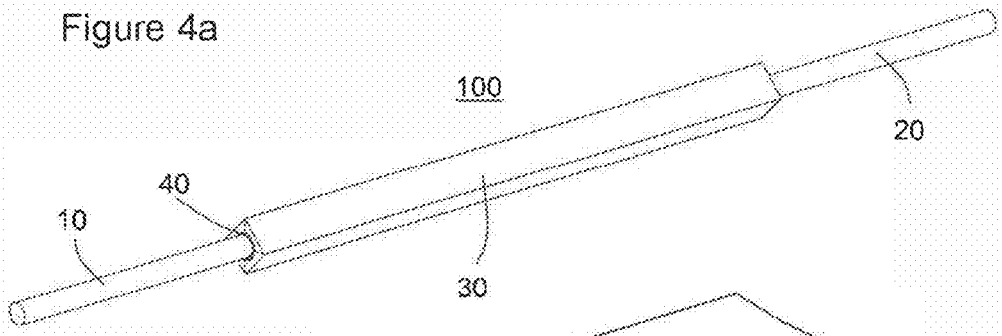
FIG. 4*a* shows a schematic drawing of a connector according to a further embodiment of the present invention.
Figure 4B:
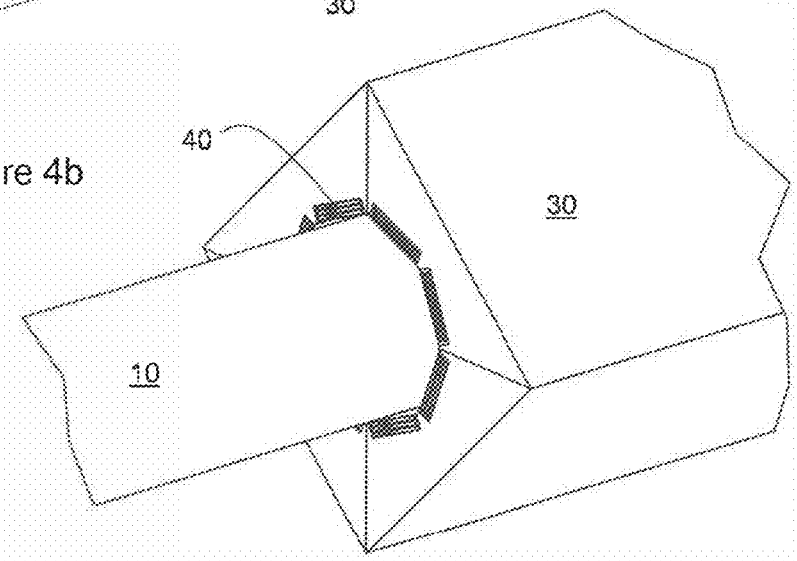
FIG. 4*b* shows a perspective detailed view of the connector according to FIG. 4*a;*
Figure 4C:
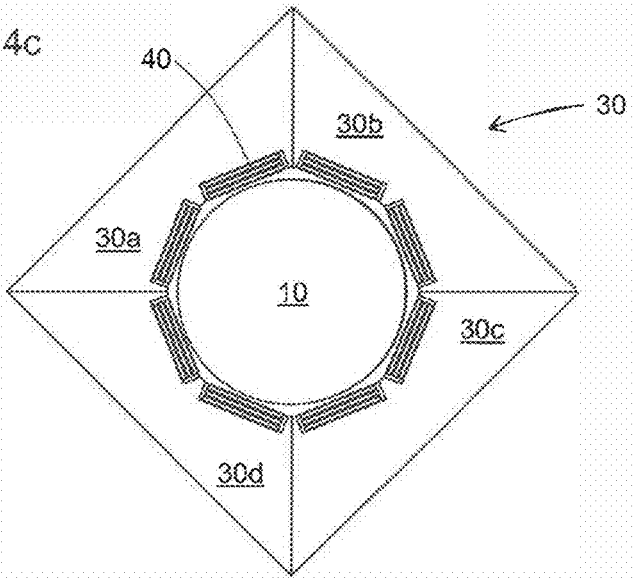
FIG. 4*c* shows a cross-sectional view of the connector according to FIG. 4*a;*

FIGS. 4*a* to 4*c* show schematic drawings of a connector 100 according to a further embodiment of the present invention. In this embodiment, the at least one superconductive additional member 40 of the connector is arranged within the base element 30, i.e. on an inner side of the base element 30 or the connector 100. This makes it possible to achieve a very low contact resistance, since the current has to flow 100 only through a thin solder layer from the superconductor of the conductor or cable 10 or 20 to the superconductive additional element 40 of the connector 100. The amount of superconductor in the connector preferably corresponds to at least the amount of superconductor in the conductor or cable 10 and 20.

As can be seen in the detailed views of FIGS. 4*b* and 4*c*, the base element 30 comprises four base element parts 30*a* to 30*d*. The base element parts 30*a* to 30*d* are each formed as quarter shells. Respectively on an inner side of the base element parts 30*a* to 30*d*, two superconductive additional elements 40 are arranged, in particular inserted, pressfitted or soldered. In the mounted or assembled state of the connector 100, the base element parts 30*a* to 30*d* are arranged around the connecting conductor or cable ends 10 and 20.

It is understood that other embodiments, in which the connector 100 or the base element 30 comprises a plurality of base element parts, are possible as well. For example, the base element may comprise one, two, three, four, five, etc., base element parts. The number and arrangement of superconductive additional elements 40 may vary.

Figure 5:
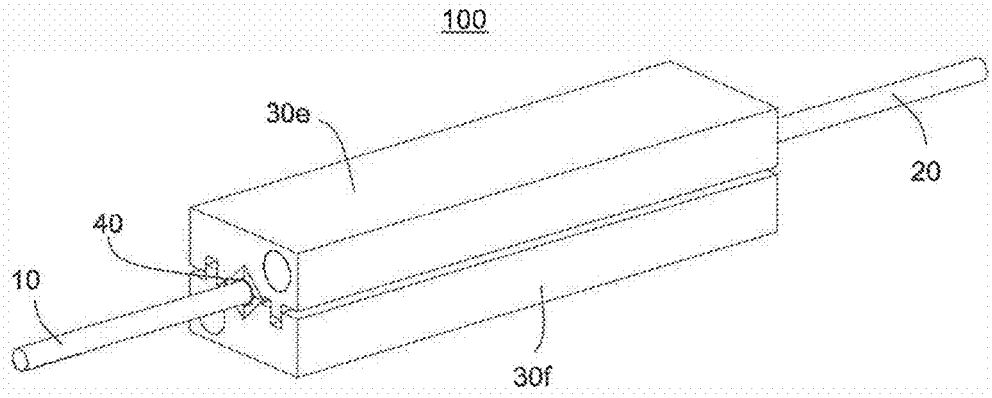
FIG. 5 shows a schematic drawing of a connector according to a further embodiment of the present invention.

FIG. 5 shows a schematic drawing of the connector according to FIGS. 4*a* to 4*c* 30*e* together with two heating and pressing devices and 30*f*. These heating and pressing devices 30*e* and 30*f* are used for heating and pressing the connector 100 during the connecting process, and are removed thereafter.

Figure 6A:
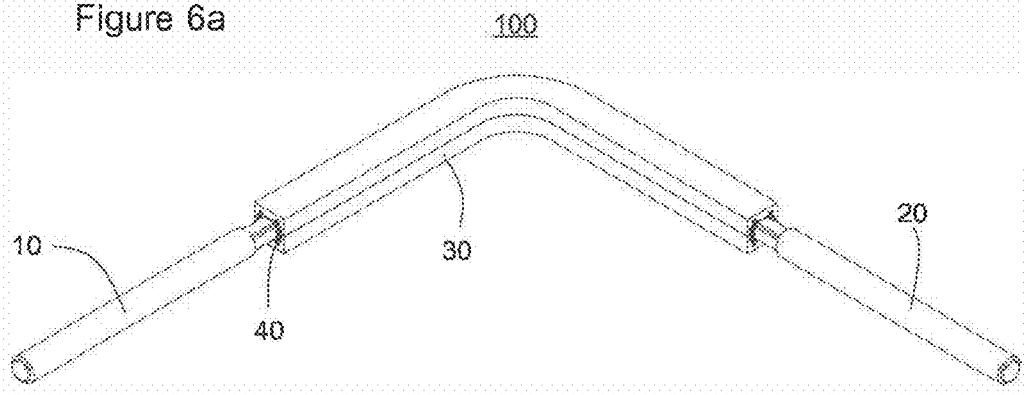
FIG. 6*a* shows a schematic drawing of a connector according to a further embodiment of the present invention
Figure 6B:
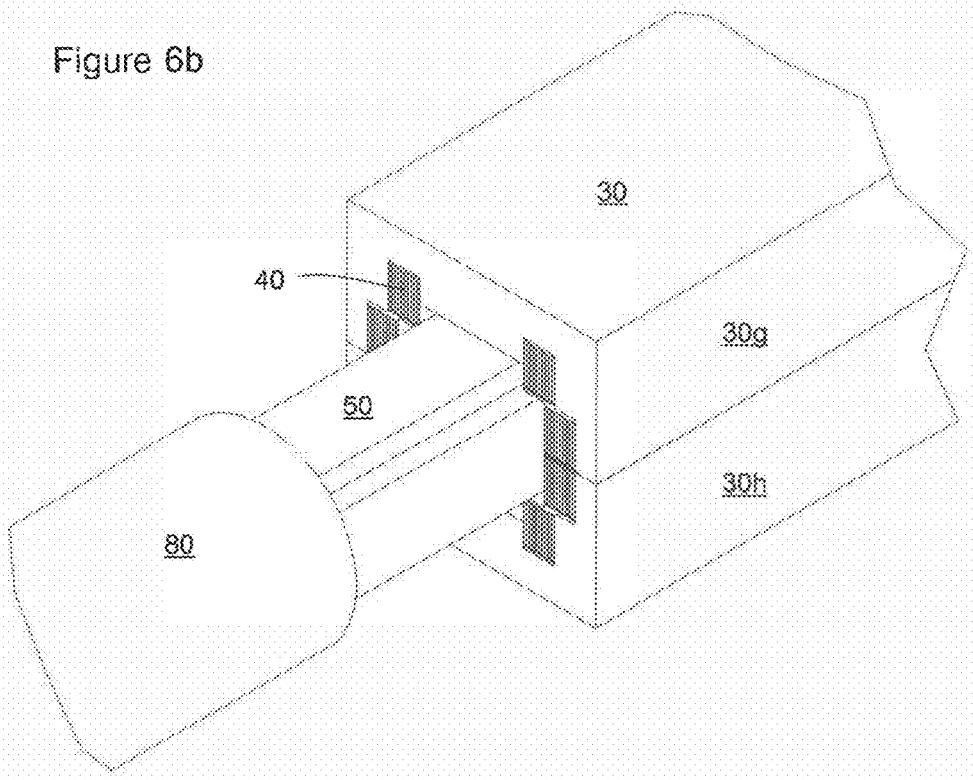
FIG. 6*b* shows a perspective detailed view of the connector according FIG. 6*a;*

FIGS. 6*a* and 6*b* show schematic drawings of a connector 100 according to a further embodiment of the present invention. In this embodiment, the connector 100 is formed to be angled. The base element 30 comprises two base element parts 30*g* and 30*h*. The at least one superconductive additional element 40 or the eight superconductive additional elements 40 are each arranged in a recess between the two base element parts 30*g* and 30*h*, i.e. within the base element 30. In this embodiment, the connector 100 is designed to connect two conductors or cables 10 and 20 that each have a superconductor body 50 with a cross-shaped cross-section, The conductors or cables 10 and 20 each have a cladding tube 80, which surrounds the superconductor body 50. Both the superconductor body 50 and the cladding tube 80 can be contacted with the end portions of the connector 100. In particular, the cable ends can be placed between the base element parts 30*g* and 30*h* and then be connected, in particular soldered and/or pressed thereto.

In the angled connector 100, the superconductive additional elements or the superconductor strips are all oriented in the same plane in order to lead them along their easy bending axis about the 90° angle in a degradation-free manner.

Figure 7A:
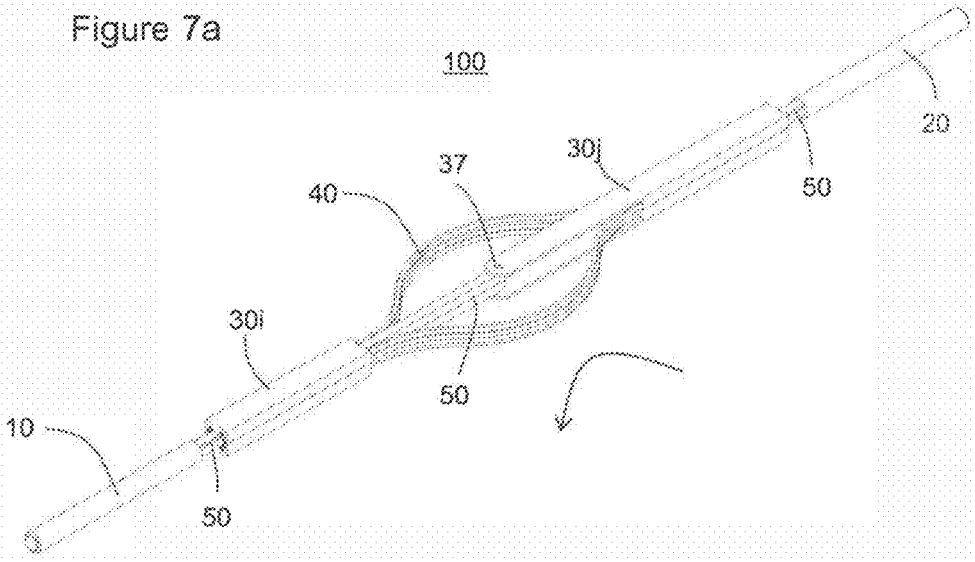
FIG. 7*a* shows a schematic drawing of a connector according to a further embodiment of the present invention.
Figure 7B:
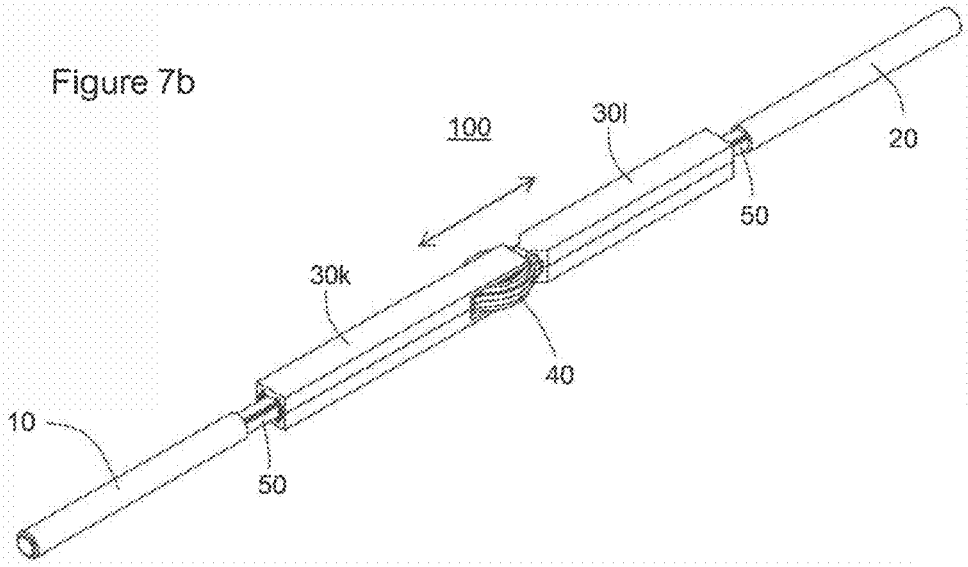
FIG. 7*b* shows a schematic drawing of a connector according to a further embodiment of the present invention.

FIGS. 7*a* and 7*b* show schematic drawings of a connector 100 according to further embodiments of the present invention.

In the embodiment of FIG. 7*a*, the connector 100 includes, in a central portion of the s connector 100, a joint or hinge 37, by which an angle of the connector 100 is variable or adjustable. This is shown schematically by a curved arrow in FIG. 7*a*. The superconductive additional elements 40 or superconductor strips extending through the connector are bent in a C-shaped fashion in the central portion of the connector 100 and thus, in comparison to the base element 30 and the base element parts 30*i* and 30*j* as well as to the connector 100 itself, have a greater length. The minimum bending radius of REBCO strips in an easy bending direction is typically 1 cm. Therefore, the superconductive strips preferably have a C-shaped curve with a radius of >1 cm, so that bending of the superconductor remains degradation-free in this way.

In the embodiment of FIG. 7*b*, the connector 100 can be varied in length, or its length can be adjusted, along a groove or displacement groove. This is shown schematically by a straight arrow in FIG. 7*b*. This is particularly advantageous when the connector 100 is cooled below the transition temperature, in order to compensate for length variations occurring thereby.

The superconductive additional elements or superconductor strips 40 extending through the connector are bent in a C-shape in the central portion of the connector 100. Therefore, the superconductive strips preferably have a C-shaped curve with a radius of >1 cm, so that bending of the superconductor remains degradation-free in this way and the current can still be transmitted in the case of changes in length of the base body.

The cross section of the connector 100 is preferably selected such that in the quench case, the current can flow via the base element 30 or the base element parts until cut-off.

The connector 100 of the invention can thus he used for connecting at least one first superconductive conductor with at least one second superconductive conductor. Here, the at least one first and the at least one second superconductive conductor can each comprise a plurality of superconductor strips, which are each arranged into a strip stack and each form a superconductor body of the respective superconductive conductor.

Figure 8:
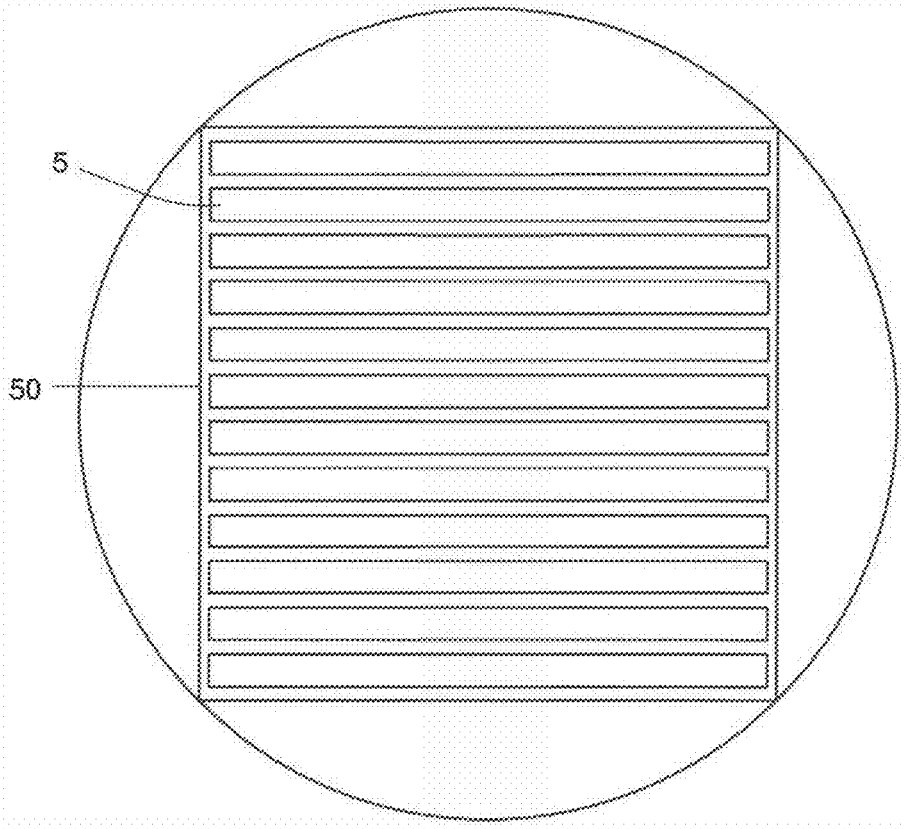
FIG. 8 shows a schematic drawing of the cross section of an exemplary superconductive conductor, which can be connected with another conductor by means of the connector according to the invention.
Figure 9:
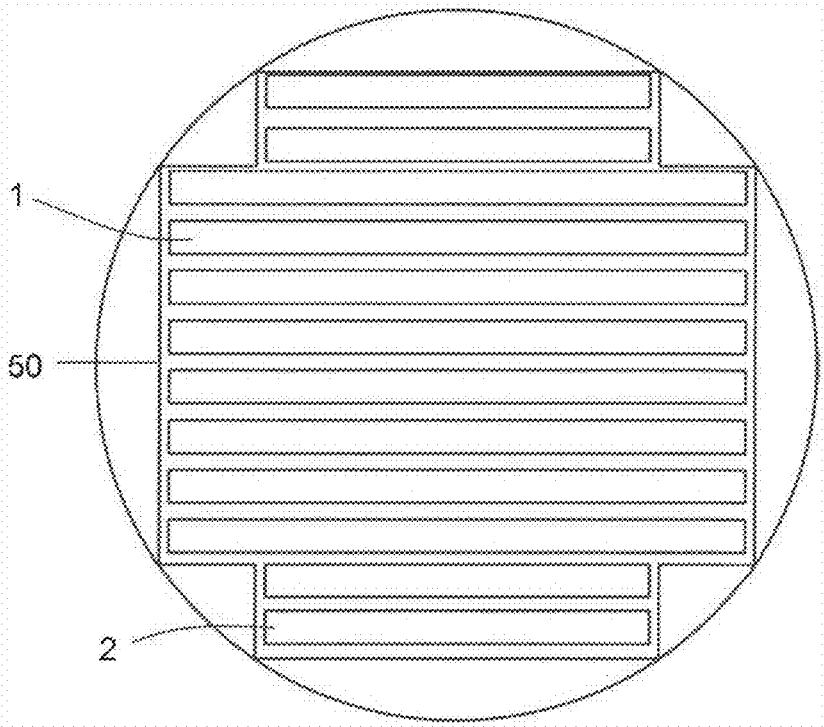
FIG. 9 shows a schematic drawing of the cross section of another exemplary superconductive conductor, which can be connected with another conductor by means of the connector according to the invention.

FIGS. 8 and 9 show two examples of a superconductive conductor, which can be connected electrically or superconductingly with the connector 100 according to the invention.

FIG. 8 shows a schematic image of the cross section of an exemplary superconductive conductor 10 and 20, which can be connected with a further conductor by means of the connector according to the invention. The superconductive conductor 10 and 20 comprises several superconductor strips 3, which each have the same width and are stacked. The cross section of the stacked superconductor strips 3 is rectangular or square in this example. A superconductor body 50 is formed by the strip stack.

FIG. 9 shows a schematic image of the cross section of a further exemplary superconductive conductor 10 or 20, which can be connected with a further conductor by means of the connector according to the invention. In comparison with the superconductive conductor of FIG. 8, the strip stack or superconductor body 50 does not have a square, but a cross-shaped cross-section. This is achieved by using superconductor strips 1 and 2 with two different widths in order to form the superconductor stack or superconductor body 50.

The end portions 32 and 34 of connector 100 can each be contacted with the superconductor body 50 of a superconductive conductor or cable. A superconductive conductor may also comprise a cladding tube 80. In particular, the superconductor body 50 of a superconductive conductor may be surrounded by a cladding tube 80. This cladding tube 80 may also be contacted at an end portion 32, 34 of the connector 100. In this way, a connection or contact is possible in a very simple and stable manner.

The connector 100 of the invention and the associated modular connection concept, i.e. provision of a plurality of connectors with different angles d, allows easy technical usability of superconductive conductors or cables even with complex geometries. With the help of the connector 100, the superconductive conductors can be laid analogous to a water pipe. Here, the connector plays the role of a press or solder fitting, while the superconductive conductors or cables play the role of pipes to be connected.

LIST OF REFERENCE NUMERALS

1 superconductor strip
2 superconductor strip
5 superconductor strip
10 first superconductive conductor or first superconductive cable
15 intermediate piece/copper block
20 second superconductive conductor or second superconductive cable
30 base element/copper block
30*a* part of the base element
30*b* part of the base element
30*c* part of the base element
30*d* part of the base element
30*e* heating and pressing device
30*f* heating and pressing device
30*g* part of the base element
30*h* part of the base element
30*i* part of the base element
30*j* part of the base element
30*k* part of the base element
30*l* part of the base element
32 first end portion/first end
34 second end portion/second end
37 joint/hinge
40 superconductive additional element
50 superconductor stack/superconductor body
80 cladding tube
100 connector

The invention claimed is:

1. A connector for electrically connecting at least one first superconductive conductor to at least one second superconductive conductor, the connector comprising:

an electrically conductive base element having a first end portion, at which the at least one first superconductive conductor is electrically contactable, and a second end portion, at which the at least one second superconductive conductor is electrically contactable; and at least one superconductive additional element arranged in the base element, at least in part, and extending from the first end portion to the second end portion of the base element.

2. The connector according to claim 1, wherein the base element has at least one recess or groove, in which the at least one superconductive additional element is arranged, at least in part, and/or wherein the at least one superconductive additional element is electrically in contact with the base element.

3. The connector according to claim 1, wherein the base element comprises a plurality of base element parts.

4. The connector according to claim 3, wherein a length of the at least one superconductive additional element is greater than the sum of lengths of the base element parts.

5. The connector according to claim 4, further comprising a displacement groove, in which at least one of the base element parts is displaceable.

6. The connector according to claim 1, wherein the base element is suitable to electrically connect n first superconductive conductors with n second superconductive conductors, wherein the connector comprises n or an integral multiple of n superconductive additional elements, and wherein n is a natural integer greater than zero.

7. The connector according to claim 1, wherein the at least one conductive base element is formed to be rectilinear or angled.

8. A method of using the connector of claim 1, the method comprising:

connecting at least one first superconductive conductor to at least one second superconductive conductor, wherein the at least one first and the at least one second superconductive conductor each include a plurality of superconductor strips, which are each arranged into a strip stack and each form a superconductor body of the respective superconductive conductor.

9. The method according to claim 8 wherein the superconductor body has a cross-shaped cross-section.

10. The method according to claim 8, wherein the strip stack of the superconductor body has superconductor strips with exactly two different widths.

11. The method according to claim 8, wherein the first end portion of the connector is electrically contacted with the superconductor body of the at least one first superconductive conductor and/or the second end portion of the connector is electrically contacted with the superconductor body of the at least one second superconductive conductor.

12. The method according to claim 8, wherein the first end portion of the connector is electrically contacted with a cladding tube of the at least one first superconductive conductor-and/or the second end portion of the connector is electrically contacted with a cladding tube of the at least one second superconductive conductor.

13. The method according to claim 8, wherein the first end portion of the connector is electrically contacted with both the cladding tube and the superconductor body of the at least one first superconductive conductor.

14. The method according to claim 11, wherein electrical contacting is performed by pressfitting or thermal joining.

15. The connector according to claim 1, wherein the base element comprises a joint and/or wherein the base element is formed of copper partially or completely and/or wherein the at least one superconductive additional element comprises a superconductor strip or a stack of superconductor strips.

16. The connector according to claim 1, wherein the base element is formed of copper partially or completely and/or wherein the at least one superconductive additional element comprises a superconductor strip or a stack of superconductor strips.

17. The connector according to claim 1, wherein the at least one superconductive additional element comprises a superconductor strip or a stack of superconductor strips.

18. The connector according to claim 7, wherein the at least one conductive base element is formed such that in an assembled state of the connector, a longitudinal axis of the at least one first superconductive conductor and a longitudinal axis of the at least one second superconductive conductor enclose an angle between 0° and 180°.

19. The method according to claim 13, wherein the second end portion of the connector is electrically contacted with both the cladding tube and the superconductor body of the at least one second superconductive conductor.

* * * * *